US005565734A

United States Patent [19]

Pinot

[11] Patent Number: 5,565,734

[45] Date of Patent: Oct. 15, 1996

[54] ELECTRIC INCANDESCENT LAMP HAVING FILAMENT SLEEVES ENGAGED BY ENVELOPE CONSTRICTIONS SUPPORTING THE FILAMENT

[75] Inventor: Gervais Pinot, Pont-á-Mousson, France

[73] Assignee: U.S. Philips Corporation, New York, N.Y.

[21] Appl. No.: 213,484

[22] Filed: Mar. 14, 1994

[30] Foreign Application Priority Data

Mar. 19, 1993 [EP] European Pat. Off. ..... 93200804

[51] Int. Cl.[6] ..... H01J 1/88

[52] U.S. Cl. ..... 313/578; 313/271; 313/285; 313/315; 313/579; 313/623

[58] Field of Search ..... 313/578, 579, 313/611, 623, 271, 285, 315, 356

[56] References Cited

U.S. PATENT DOCUMENTS

| | | | |
|---|---|---|---|
| 3,538,374 | 11/1970 | Kane | 313/578 |
| 5,006,757 | 4/1991 | Odagaki | 313/623 |
| 5,146,134 | 9/1992 | Stadler et al. | 313/579 |

FOREIGN PATENT DOCUMENTS

| | | | |
|---|---|---|---|
| 0446458 | 9/1991 | European Pat. Off. | H01K 1/24 |

*Primary Examiner*—Sandra L. O'Shea
*Assistant Examiner*—Matthew J. Esserman
*Attorney, Agent, or Firm*—Eugene J. Rosenthal

[57] ABSTRACT

The electric incandescent lamp has a filament (2) centrically supported in a tubular envelope (1) by constrictions (6) in the envelope at areas where a refractory metal member (7) short-circuits turns (3') of the filament. The refractory metal member (7) is a sleeve around the filament (2).

14 Claims, 1 Drawing Sheet

ELECTRIC INCANDESCENT LAMP HAVING FILAMENT SLEEVES ENGAGED BY ENVELOPE CONSTRICTIONS SUPPORTING THE FILAMENT

BACKGROUND OF THE INVENTION

The invention relates to an electric incandescent lamp comprising:

a tubular sealed glass envelope;

a helically coiled tungsten filament having turns, accommodated within the envelope, the filament having end portions which are connected to current conductors passing through the envelope to the outside, the filament being supported between its end portions by at least one constriction made in the glass envelope at an area where turns of the filament are short-circuited by a member of refractory metal.

Such an electric incandescent lamp is known from EP 0 446 458 A2.

The filament must be supported between its end portions in order to prevent the filament from approaching the envelope too closely or even touching it. A local overheating of the envelope is thereby prevented. Supporting the filament also results in the possibility to align the filament with respect to a reflector in which the lamp is used.

Wire-wound supports are present on the filament in most incandescent lamps to support the filament. These supports are applied to the filament when the coiling mandrel onto which the filament was coiled, is still present. The supports have a helically coiled portion about the filament, and a spiralling portion engaging the envelope. The filament must then be processed in order to remove the winding mandrel by etching and to secure current conductors. The processing of the filaments provided with their supports is cumbersome, however, because of the projecting supports. The supports of the filaments may, moreover, hook into one another, necessitating their disentanglement.

According to EP 0 446 458 A2, the filament may be supported by constrictions in the envelope directly engaging the filament in quartz glass lamps consuming a low power of up to 75 W. In quartz glass lamps consuming a higher power the constriction may touch a spacer in the filament. A spacer may be a single-coiled section or a non-coiled section of the filament between two coiled sections. Such intermediate sections consume less power per unit of filament length, have a lower temperature and may therefore be in contact with a quartz glass envelope without causing damage to the envelope.

It is said to be advantageous to have a core rod present in the filament at the area where it is in direct contact with the envelope. The core rod short-circuits turns of the filament, thereby lowering their temperature.

It is cumbersome, however, to maintain part of the winding mandrel as a core rod in the filament because to that end the filament must be coated locally with a wax to protect the mandrel against the etching liquid before etching of the mandrel, and the wax must be removed later on. As the mandrel must be dissolved and the filament must be conserved, the mandrel has to be of a different metal, usually molybdenum. It is a disadvantage, however, that the presence of this other metal in the completed lamp cannot be avoided in lamps of this construction. In principle, it would be possible to introduce a core rod into a finished filament, but this requires a lot of manipulation and involves the risk of filament distortion.

SUMMARY OF THE INVENTION

It is an object of the invention to provide an electric incandescent lamp of the kind described in the opening paragraph which is of a construction which can be readily obtained.

According to the invention this object is achieved in that the member of refractory metal is a sleeve around the filament.

The sleeve can be readily applied over the filament without much manipulation, because its place is at the outside thereof. The sleeve may be applied, if so desired, when a winding mandrel is still present.

It is an advantage of the lamp of the invention that the use of molybdenum or another refractory metal other than tungsten in the lamp may be easily avoided if this other refractory metal would be detrimental to the performance of the lamp.

The sleeve may be a tube which may have a longitudinal slit. The sleeve may alternatively be a foil wrapped about the filament. If so desired, the sleeve may be flattened or indented onto the filament.

Another possibility is, however, that the sleeve is made of coiled, for example, helically coiled wire. The sleeve may be integral with the filament in that, during coiling of the filament, the wire is coiled backwards onto turns already made, and subsequently coiled in the original direction again. A section having three layers of turns results therefrom. The pitch of the turns of these layers, however, need not be the same. For example, the pitch in the intermediate layer could be relatively large.

Contrary to conventional incandescent lamps, in which the filament is supported by wire-wound supports which spiral towards the envelope, in lamps according to the invention wire-wound sleeves lead to a relatively small increase of the local diameter of the filaments which hardly influences the processing of the filaments into finished lamps.

Refractory metals such as tungsten, molybdenum, tantalum, may be used. The electric lamp may have a filling containing, apart from inert gas, a halogen or a halogen-containing compound, like hydrogen bromide. The lamp may consume a relatively high power of, e.g., up to 2 kW or more. The size of the sleeve depends on the maximum temperature the glass used in the envelope can resist. In the case of quartz glass for instance, it is advisable to limit the temperature to about 900° C. Alternatively, however, hard glass may be used. In that event, the maximum temperature generally should be lower in accordance with the properties of the particular kind of glass. The actual permissible temperature will be clear to those skilled in the art from the properties of the glass. The size and the thickness of the sleeve required to comply with the maximum permissible temperature can be established in a few trials for each kind of lamp without undue experimentation. In lamps consuming a power of about 200 W, a sleeve of e.g. tungsten having a thickness of about 50 μm suffices in quartz glass envelopes. The sleeve may be present around the turns of a single coiled filament, the secondary turns of a coiled coil filament or around the turns of a single-coiled section of a coiled coil filament.

The lamp may be designed for use at mains voltage, e.g. 110 V or 230–240 V. The lamp may have a double-ended envelope or a single-ended envelope. The filament may be accommodated centrically or be kept spaced eccentrically therein.

BRIEF DESCRIPTION OF THE DRAWINGS

Embodiments of the electric incandescent lamp according to the invention are shown in the drawings in which.

DESCRIPTION OF THE PREFERRED EMBODIMENTS

Figure 1:
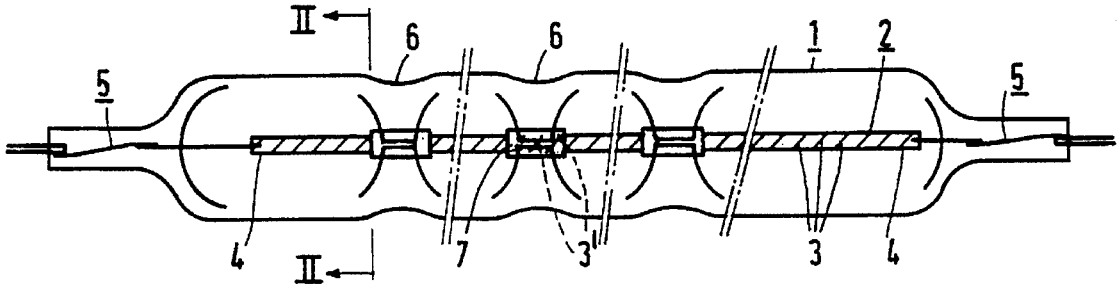
FIG. 1 shows a lamp in side elevation.
Figure 2:
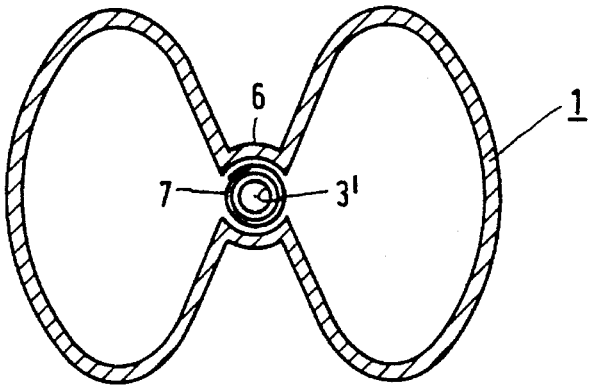
FIG. 2 shows a cross section through FIG. 1 on an enlarged scale.

The electric incandescent lamp of FIG. 1 comprises a tubular sealed quartz glass envelope 1 and a helically coiled tungsten filament 2 having turns 3, accommodated centrically within the envelope. The filament 2 has end portions 4 which are connected to current conductors 5 passing through the envelope 1 to the outside. The filament 2 is supported between its end portions 4 by at least one constriction 6 made in the envelope 1 at an area where turns 3' of the filament are short-circuited by a member 7 of refractory metal.

The member of refractory metal 7 is a sleeve around the filament 2. In the Figure, the sleeve is a foil wrapped about the filament and the filament has a pitch, at the location surrounded by the sleeve (turns 3'), equal to the pitch of the filament at regions adjacent said sleeve (turns 3).

In the following Figures, corresponding parts have reference numbers which are 10 higher each time than in the preceding Figure.

Figure 3:
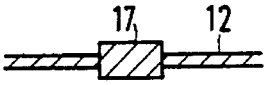
FIG. 3 shows a detail of another embodiment.

In FIG. 3, the sleeve 17 is a separate wire, for example made of tungsten, which is coiled around the filament 12.

Figure 4A:
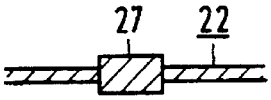
FIG. 4*a* shows a detail of a variation of FIG. 3.
Figure 4B:
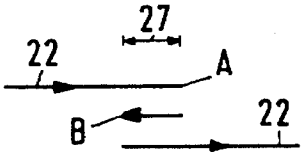
FIG. 4*b* shows a schematic representation of FIG. 4*a;*

In the variation of FIG. 4, the sleeve 27 is integral with the filament 22. In manufacturing, the filament is coiled up to point A in FIG. 4*b*. Then the coiling direction is reversed and the wire is coiled over the filament up to point B. Subsequently the wire is coiled in the original direction to complete the filament.

Figure 5:
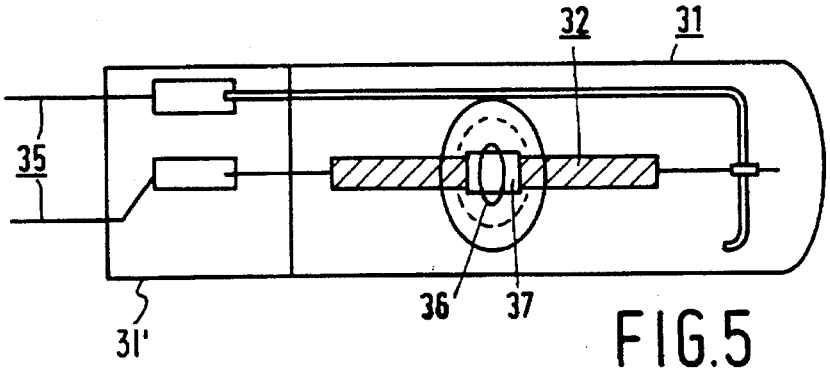
FIG. 5 shows yet another embodiment in side elevation.

In FIG. 5, the lamp has a single-ended quartz glass envelope 31, both current conductors 35 issuing from the seal 31'. Constriction 36 of envelope 31 supports the filament 32 via sleeve 37.

I claim:

1. An electric incandescent lamp comprising:

a tubular sealed glass envelope;

a helically coiled tungsten filament having turns, and disposed within the envelope, the filament having end portions which are connected to current conductors passing through the envelope to the outside, the filament being supported between its end portions by at least one constriction made in the glass envelope at an area where turns of the filament are short-circuited by a member of refractory metal, characterized in that the member of refractory metal is a sleeve around the filament.

2. An electric incandescent lamp as claimed in claim 1, characterized in that the sleeve is a foil wrapped about the filament.

3. An electric incandescent lamp as claimed in claim 1, characterized in that the sleeve is a wire coiled around the filament.

4. An electric incandescent lamp as claimed in claim 3, characterized in that the sleeve is integral with the filament.

5. An electric lamp according to claim 4, wherein said sleeve is comprised by said filament having a first plurality of turns extending in a first direction, a second plurality of turns wound on the first plurality of turns and extending in a second direction opposite to the first direction, and a third plurality of turns wound on the second plurality of turns and extending in the first direction.

6. An electric incandescent lamp, comprising:

a) a sealed lamp envelope;

b) a coiled filament disposed within said lamp envelope and having filament turns;

c) means for connecting said filament to a source of electric potential outside of said lamp envelope;

said lamp envelope including a constriction for positioning said filament; and d) a sleeve of refractory metal disposed on said filament at the location of said constriction, said sleeve conductively connecting a plurality of said filament turns at said constriction.

7. An electric lamp according to claim 6, wherein said envelope includes a pair of opposing constrictions fixing said sleeve therebetween.

8. An electric lamp according to claim 7, wherein said envelope is tubular.

9. An electric lamp according to claim 8, wherein said lamp includes a plurality of said opposing constrictions spaced axially along said lamp envelope.

10. An electric lamp according to claim 6, wherein said sleeve consists of a foil surrounding a portion of said filament.

11. An electric lamp according to claim 10, wherein said filament has a pitch, at the location surrounded by said sleeve, equal to the pitch of said filament at regions adjacent said sleeve.

12. An electric lamp according to claim 6, wherein said sleeve consists of a separate wire coiled about said filament.

13. An electric lamp according to claim 12, wherein said filament has a pitch, at the location surrounded by said sleeve, equal to the pitch of said filament at regions adjacent said sleeve.

14. An electric lamp according to claim 6, wherein said sleeve consists of a first plurality of turns extending in a first direction, a second plurality of turns wound on the first plurality of turns and extending in a second direction opposite to the first direction, and a third plurality of turns wound on the second plurality of turns and extending in the first direction.

* * * * *